US007857648B2

(12) United States Patent
Hsieh

(10) Patent No.: US 7,857,648 B2
(45) Date of Patent: Dec. 28, 2010

(54) ELECTRICAL CONNECTOR HAVING LOCKING MECHANISM

(75) Inventor: Fu-Pin Hsieh, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 204 days.

(21) Appl. No.: 12/215,503

(22) Filed: Jun. 26, 2008

(65) Prior Publication Data

US 2009/0004905 A1 Jan. 1, 2009

(30) Foreign Application Priority Data

Jun. 29, 2007 (CN) ..... 2007 2 0039009

(51) Int. Cl.
*H01R 13/62* (2006.01)

(52) U.S. Cl. ..... 439/331

(58) Field of Classification Search ..... 439/331, 439/940, 135, 330, 73
See application file for complete search history.

(56) References Cited

U.S. PATENT DOCUMENTS

| | | | | |
|---|---|---|---|---|
| 6,019,617 | A * | 2/2000 | Liu et al. | 439/135 |
| 6,561,825 | B1 * | 5/2003 | McHugh et al. | 439/135 |
| 6,618,259 | B1 * | 9/2003 | Hood et al. | 361/740 |
| 6,929,505 | B2 * | 8/2005 | He et al. | 439/526 |
| 6,945,799 | B2 * | 9/2005 | Huang | 439/135 |
| 7,578,684 | B2 * | 8/2009 | Liao | 439/135 |
| 7,658,627 | B2 * | 2/2010 | Lin et al. | 439/135 |

FOREIGN PATENT DOCUMENTS

CN 200959472 Y 10/2007

* cited by examiner

*Primary Examiner*—Xuong M Chung Trans
(74) *Attorney, Agent, or Firm*—Andrew C. Cheng; Wei Te Chung; Ming Chieh Chang

(57) ABSTRACT

An electrical connector (1) adapted for electrically connecting an electronic package includes a housing (2), a cover (3) and a locking mechanism. The housing has a bottom wall (21), a number of rising walls (22-24) and a receiving space (27) defined therebetween. The cover is attached to a top portion of the housing and has a pair of downwardly extending side walls (32). The locking mechanism includes a locking groove (220) defined on the rising wall of the housing, and a locking post (35) formed on a corresponding side wall of the cover and slidable in the locking groove between a locked position and a released position.

2 Claims, 3 Drawing Sheets

ELECTRICAL CONNECTOR HAVING LOCKING MECHANISM

BACKGROUND OF THE INVENTION

1. Field of the Invention

The present invention relates to an electrical connector, and particularly to an electrical connector electrically connecting an electronic package such as an IC package to a circuit board.

2. Description of Related Art

An electrical connector comprises a housing having a plurality of contacts, a stiffener surrounding the housing and formed with an engaging portion, a cover rotatably mounted on the housing and having a tongue portion, and an L-shaped lever mounted along outer sides of the housing and engaging with the tongue portion of the cover. When an IC package is positioned on the housing, the cover is rotated from an open position to a closed position and fasten the IC package at the closed position via an engagement between the lever and the engaging portion.

The cover could fasten the IC package at the closed position, when the lever is rotated to the closed position and engages with the engaging portion of the stiffener. It is complicated to assemble the lever onto the housing and rotate the lever between the open position and the closed position. Simultaneously, the lever is assembled along the outer sides of the housing and would take up a certain extra space. It is therefore hard to realize the miniaturization of the electrical connector.

Hence, an improved electrical connector is required to overcome the above-mentioned disadvantages of the related art.

SUMMARY OF THE INVENTION

An object of the present invention is to provide an minimized electrical connector which is easy to assemble.

To achieve the aforementioned objects, an electrical connector adapted for electrically connecting an IC package includes a housing, a cover and a locking mechanism. The housing has a bottom wall, a number of rising walls rising from the bottom wall and a receiving space defined therebetween. The cover is attached to a top portion of the housing and has a pair of downwardly extending side walls. The locking mechanism includes a locking groove defined on one of the rising walls of the housing, and a locking post formed on corresponding side wall of the cover and slidable in the locking groove between a locked position and a released position.

The cover could be locked on the housing to fasten the IC package or be released from the housing to remove the IC package, via the engagement or disengagement of the locking mechanism. The locking post is formed on the primary wall of the housing and the locking groove is defined on the side wall of the cover. The assembly of the electrical connector has been simplified since it doesn't need to the assemble the locking mechanism onto the housing. Additionally, it is easy to realize the miniaturization of the electrical connector, since the locking mechanism would not occupy extra space.

Other objects, advantages and novel features of the invention will become more apparent from the following detailed description of a preferred embodiment when taken in conjunction with the accompanying drawings.

DETAILED DESCRIPTION OF THE INVENTION

Figure 1:
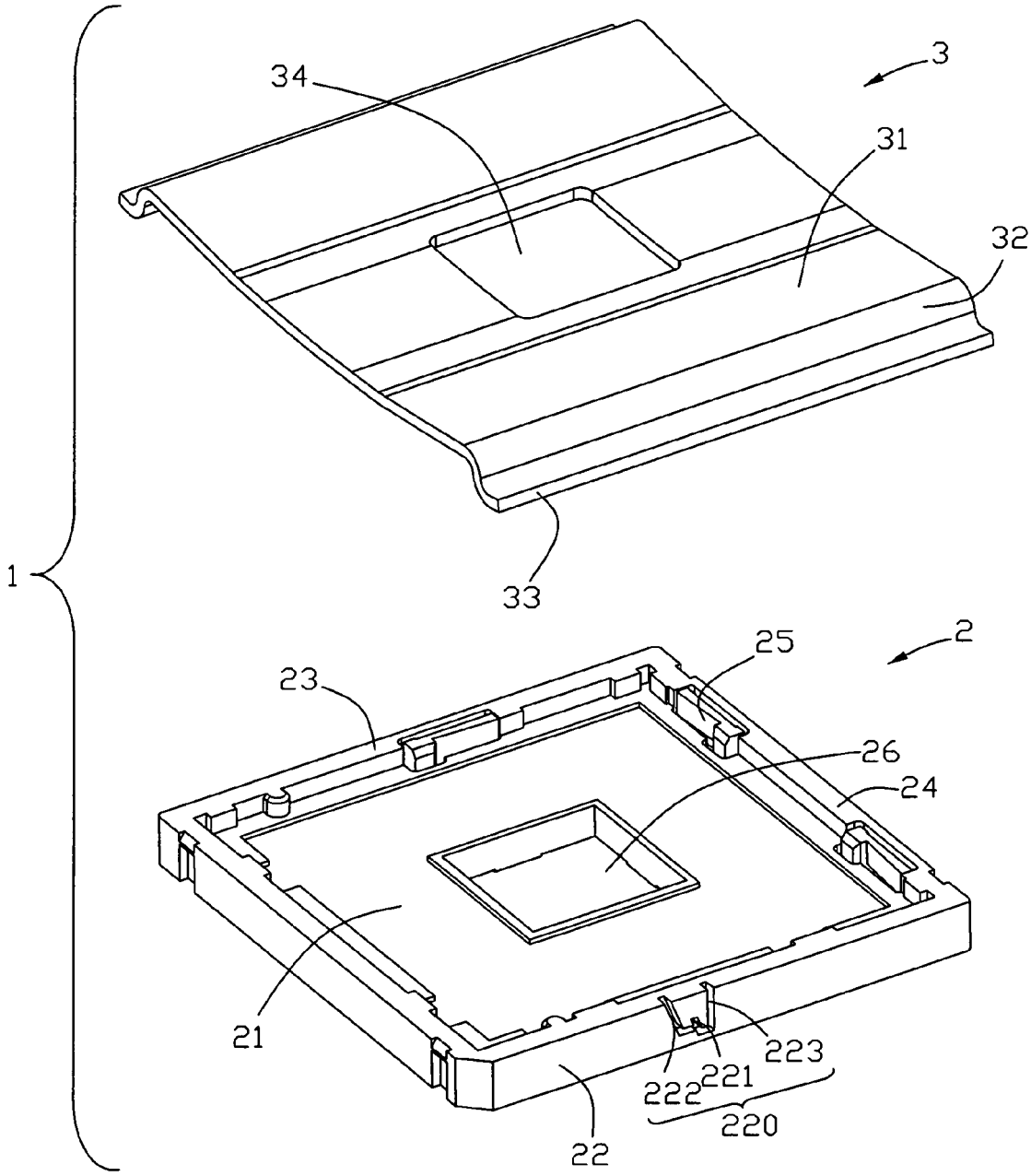
FIG. 1 is an exploded perspective view of an electrical connector in accordance with the present invention.
Figure 2:
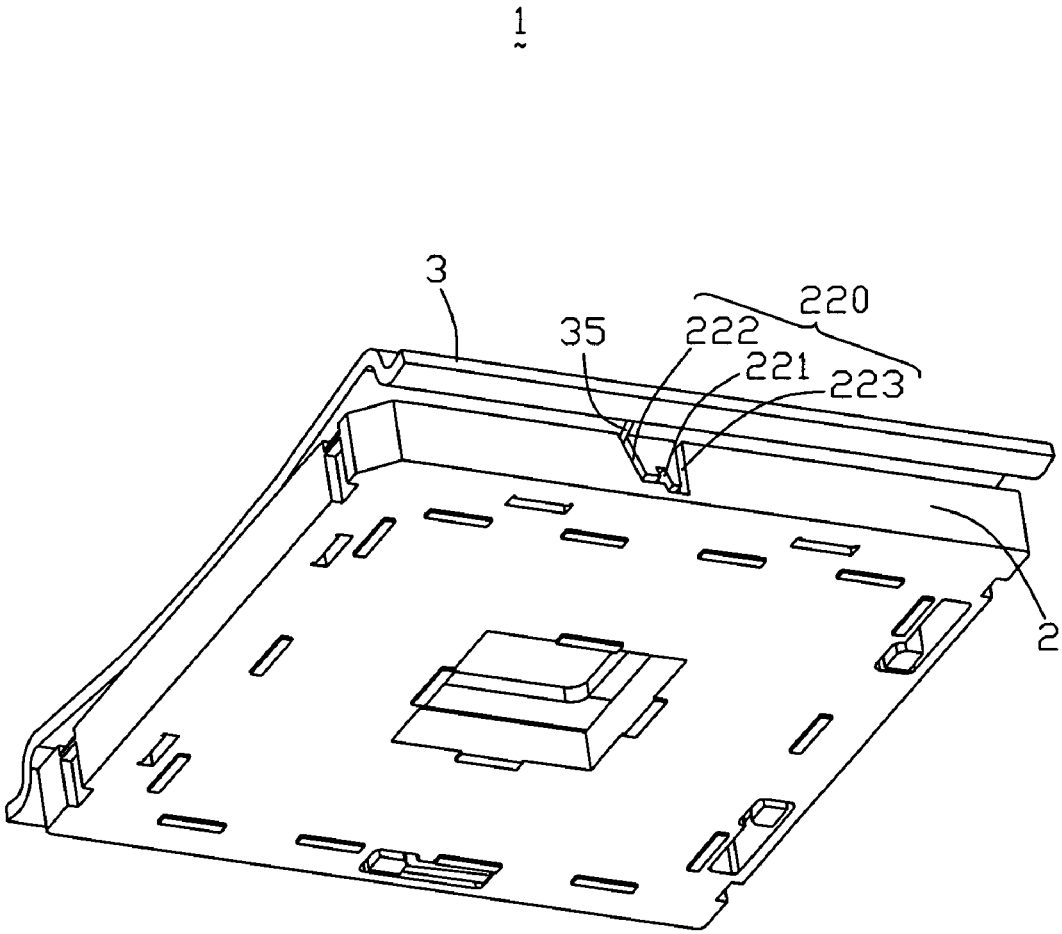
FIG. 2 is a perspective view showing a cover beginning to assemble to a housing in accordance with the present invention.
Figure 3:
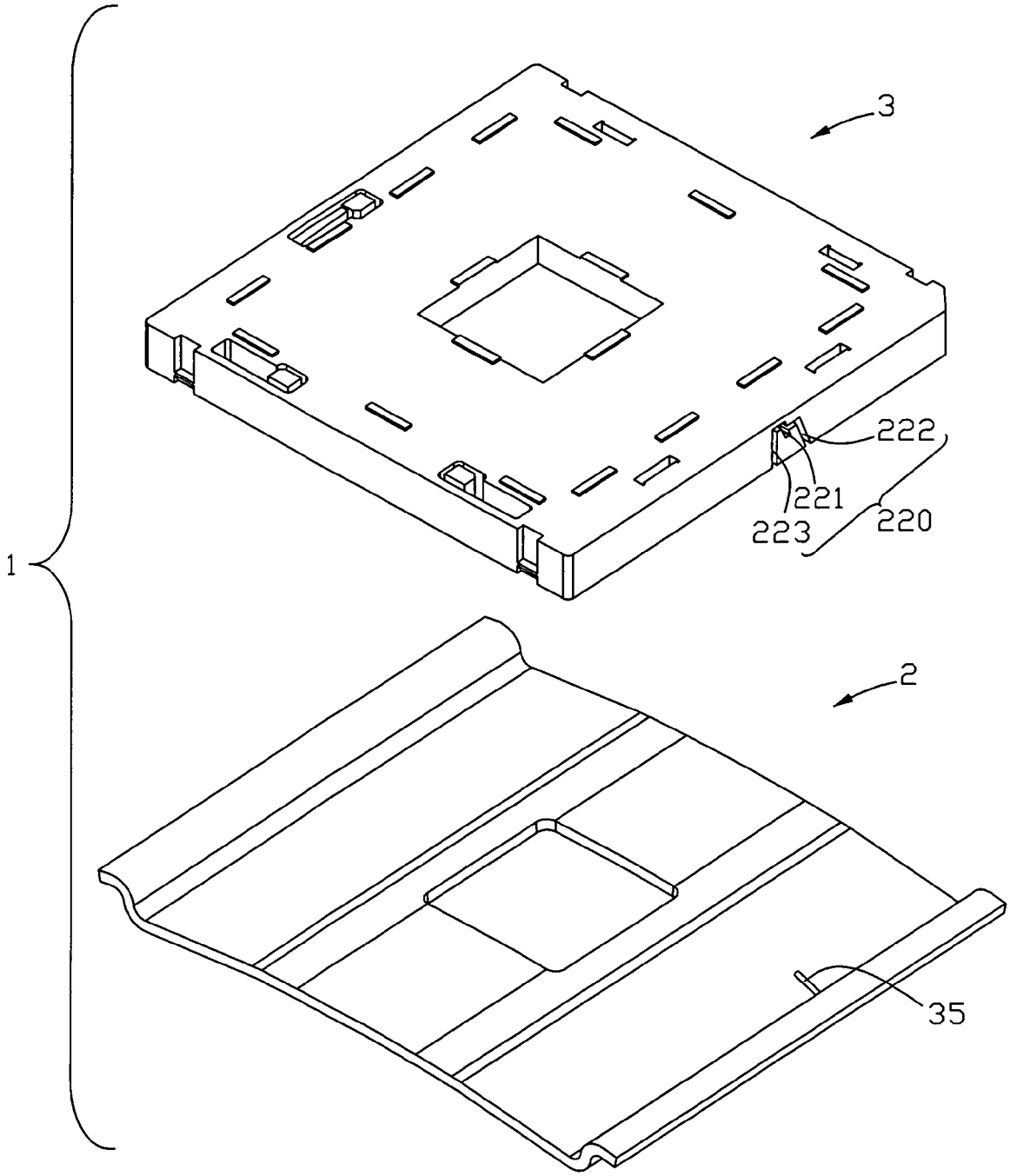
FIG. 3 is another exploded perspective view similar to FIG. 1, taken from another aspect.

Reference will now be made to the drawing figures to describe the present invention in detail. Referring to FIGS. 1-3, an electrical connector 1 adapted for receiving an IC package (not shown) in accordance with the preferred embodiment of the present invention comprises a rectangular housing 2 and a cover 3 mounted on the housing 2.

Referring to FIG. 1, the housing 2 retains therein a plurality of contacts (not shown) and comprises a bottom wall 21, a primary wall 22 rising from the bottom wall 21, a rear wall 23 opposite to the primary wall 22, a pair of periphery walls 24 interconnected with the primary wall 22 and the rear wall 23, and a receiving space 27 surrounded by the walls 21-24. The bottom wall 21 has a rectangular opening 26 defined in a center thereof. The primary wall 22 and the rear wall 23 respectively has a resilient beam 25 projecting toward the receiving space 27. Each periphery wall 24 has a pair of resilient beams 25 symmetrically formed at an inner surface thereof.

The primary wall 22 has a substantially heart-shaped locking groove 220 defined at an outer surface thereof. The locking groove 220 comprises an L-shaped guiding groove 222, an L-shaped releasing groove 223 communicating with the guiding groove 222, and a fixing groove 221 defined between the guiding groove 222 and the releasing groove 223. The fixing groove 221 is connected with a lower end of the guiding groove 222 and a lower end of the releasing groove 223. The lower end of the releasing groove 223 is deeper than the lower end of the guiding groove 222.

Referring to FIGS. 1 and 3, the cover 3 comprises a top wall 31, a pair of L-shaped side walls 32 extending downwardly from opposite edges of the top wall 31. The top wall 31 has a window 34 corresponding to the opening 26 defined in a center of the top wall 31. In conjunction with FIG. 3, the side wall 32 is provided with a locking post 35 projecting inwardly. The locking groove 220 and the locking post 35 are coupled as a locking mechanism (not labeled).

In conjunction with FIG. 2, when the IC package is guided into the receiving space 27 and resisted against by the resilient beams 25, the cover 3 is attached to a top portion of the housing 2. When the cover 3 is depressed downwardly, the locking post 35 is guided into the guiding groove 222 and slides downwardly along the guiding groove 222 till it has been plunged into the fixing groove 221 at a locked position. The cover 3 is locked on the housing 2 to fasten the IC package in the receiving space 27, when the locking post 35 arrives at the locked position.

When the IC package needs to be removed from the housing 2, the cover 3 is depressed downwardly and the locking post 35 slides into the releasing groove 223 from the fixing groove 221. The locking post 35 escapes from the releasing groove 223 and restores itself to a released position. The cover 3 is released from the housing 2 and the IC package could be removed from the receiving space 27.

It is easy to lock the IC package on the housing 2 and release the IC package from the housing 2, if only depressing the cover 3 to drive the locking mechanism. The locking mechanism is formed on the primary wall 22 of the housing 2 and the side wall 35 of the cover 3 and doesn't occupy extra space.

However, the disclosure is illustrative only, changes may be made in detail, especially in matter of shape, size, and arrangement of parts within the principles of the invention.

What is claimed is:

1. An electrical connector adapted for electrically connecting an electronic package, comprising:

a housing and a plurality of contacts received in the housing, the housing having a bottom wall, a plurality of rising walls rising from the bottom wall and a receiving space defined therebetween;

a cover attached to a top portion of the housing and having a pair of downwardly extending side walls; and a locking mechanism comprising a locking groove defined in an exterior face of one of the rising walls of the housing, and a locking post formed on an interior face of a corresponding side wall of the cover and slidable in the locking groove between a locked position and a released position, said locking groove having an entrance and an exit, said locking post entering into said locking groove via said entrance and leaving from said locking groove via said exit, said entrance and said exit spacing a certain distance from each other; wherein said locking groove comprises an L-shaped guiding groove, said locking post sliding in the guiding groove before the cover is locked on the housing; wherein said locking groove comprises a fixing groove connected to a lower end of the guiding groove, wherein said locking post is plunged in the fixing groove and is positioned at the locked position to lock the cover on the housing; wherein said locking groove comprises an L-shaped releasing groove having a lower end connected to the fixing groove, wherein said locking post escapes from the releasing groove and arrives at the released position to release the cover from the housing; wherein said lower end of the releasing groove is deeper than the lower end of the guiding groove; wherein said rising walls of the housing has a plurality of resilient beams formed thereon for resisting against the electronic package; wherein said bottom wall of housing has an opening defined in a center thereof, said cover defining a window corresponding to the opening.

2. An electrical connector comprising:

an insulative housing having a plurality of side walls commonly defining an upward receiving cavity for receiving an electronic package therein;

at least one retention device formed on at least one of said side walls for providing a lateral force against the electronic package; and a metallic cover attached to the housing to cover the receiving cavity and for providing a downward force against the electronic package for holding the electronic package in position; wherein one of said cover and one said side wall is equipped with a one way guiding groove, and the other one of said cover and one said side wall is equipped with a pin traveling along said groove and having a one-way operation, under a condition that said guiding groove defines an entrance exposed to an exterior, and an exit exposed to the exterior, with a resting position therebetween, said pin inserting into the guiding groove via said entrance and rested in said resting position when the cover is assembled to the housing, said pin escaping from said resting position and leaving from said guiding groove via said exit when the cover is detached from the housing; wherein said entrance and said exit are spaced and isolated a certain distance from each other; wherein said guiding groove is formed in an exterior face of one said side wall, and the pin is formed in an interior face of the cover; wherein said guiding groove defines different depths therealong so as to form a one way function for in moving; wherein said locking post moves from exterior to interior of said locking groove via said entrance, and moves from interior of said locking groove to exterior via said exit; wherein said pin travels in the guiding groove from said entrance to said exit along a track which does not contain any overlapped positions; wherein said cover experiences a horizontal movement relative to the housing during traveling of the pin from the entrance to the resting position in the guiding groove; wherein said rising walls of the housing has a plurality of resilient beams formed thereon for resisting against the electronic package; wherein said bottom wall of housing has an opening defined in a center thereof, said cover defining a window corresponding to the opening.

* * * * *